US007777707B2

(12) United States Patent
Halfant

(10) Patent No.: US 7,777,707 B2
(45) Date of Patent: Aug. 17, 2010

(54) FACTORED ZERO-DIAGONAL MATRIX FOR ENHANCING THE APPEARANCE OF MOTION ON AN LCD PANEL

(76) Inventor: Matthew Halfant, 1548 Alisal Ave., San Jose, CA (US) 95125

( * ) Notice: Subject to any disclaimer, the term of this patent is extended or adjusted under 35 U.S.C. 154(b) by 1503 days.

(21) Appl. No.: 11/061,054

(22) Filed: Feb. 18, 2005

(65) Prior Publication Data

US 2005/0195140 A1 Sep. 8, 2005

Related U.S. Application Data

(60) Provisional application No. 60/546,615, filed on Feb. 20, 2004.

(51) Int. Cl.
*G09G 3/36* (2006.01)

(52) U.S. Cl. ..... 345/87; 345/98; 345/99; 345/204

(58) Field of Classification Search ..... 345/87, 345/98–99, 204
See application file for complete search history.

(56) References Cited

U.S. PATENT DOCUMENTS 5,844,567 A * 12/1998 Gossett et al. ..... 345/586
6,304,254 B1 10/2001 Johnson
6,930,663 B2 * 8/2005 Sekiya et al. ..... 345/87
7,382,349 B1 6/2008 Kuhns
2004/0249615 A1 * 12/2004 Grzeszczuk et al. ..... 703/2

FOREIGN PATENT DOCUMENTS

WO 2004/013835 A1 2/2004

OTHER PUBLICATIONS

Lee, B.-W., et al., "41.5L: Late-News Paper: LCDs: How Fast Is Enough?" SID Symposium Digest of Technical Papers 32(1):1106-1109, Jun. 2001.
Nakamura, H., and K. Sekiya, "51.1: Overdrive Method for Reducing Response Times of Liquid Crystal Displays," SID Symposium Digest of Technical Papers 32(1):1256-1259, Jun. 2001.

* cited by examiner

*Primary Examiner*—Richard Hjerpe
*Assistant Examiner*—Leonid Shapiro
(74) *Attorney, Agent, or Firm*—Christensen O'Connor Johnson Kindness PLLC

(57) ABSTRACT

A method for reducing a response time of the pixels corresponding to a period of time required for a selected pixel at a starting pixel value to reach a target pixel value. Providing an n×n factored zero diagonal LCD overdrive matrix and for a selected pixel at a particular start pixel value, selecting a particular target pixel value to be reached in one frame time, and determining a particular overdrive pixel value based upon the particular start pixel value and the particular target pixel value using the factored zero diagonal LCD overdrive matrix. When the start pixel value and the target pixel value are equal or almost equal in value, then setting the overdrive pixel value to a main diagonal pixel value such that the start pixel value is equal to the target pixel value.

10 Claims, 2 Drawing Sheets

FACTORED ZERO-DIAGONAL MATRIX FOR ENHANCING THE APPEARANCE OF MOTION ON AN LCD PANEL

CROSS REFERENCE TO RELATED APPLICATIONS

This patent application takes priority under 35 U.S.C. 119 (e) to U.S. Provisional Patent Application No. 60/546,615, filed on Feb. 20, 2004 entitled "FACTORED ZERO DIAGONAL APPROACH TO INTERPOLATION," by Halfant, that is incorporated by reference in its entirety. This application is also related to (i) U.S. patent application Ser. No. 10/985,688, filed Nov. 10, 2004, entitled "DYNAMICAL SYSTEMS APPROACH TO LCD OVERDRIVE," by Halfant, now U.S. Pat. No. 7,348,950 issued Mar. 25, 2008, and (ii) co-pending U.S. patent application Ser. No. 11/060,876, filed Feb. 18, 2005, entitled "EXTENDED OVERDRIVE TABLE AND METHODS OF USE THEREOF FOR ENHANCING THE APPEARANCE OF MOTION ON AN LCD PANEL," by Halfant, each of which are incorporated by reference in their entireties for all purposes.

BACKGROUND

Field of the Invention

The invention relates to display devices. More specifically, the invention describes a method and apparatus for enhancing the appearance of motion on an LCD panel display.

OVERVIEW

Each pixel of an LCD panel can be directed to assume a luminance value discretized to the standard set [0, 1, 2, . . . , 255] where a triplet of such pixels provides the R, G, and B components that make up an arbitrary color which is updated each frame time, typically $1/60^{th}$ of a second. The problem with LCD pixels is that they respond sluggishly to an input command in that the pixels arrive at their target values only after several frames have elapsed, and the resulting display artifacts—"ghost" images of rapidly moving objects—are disconcerting. Ghosting occurs when the response speed of the LCD is not fast enough to keep up with the frame rate. In this case, the transition from one pixel value to another cannot be attained within the desired time frame since LCDs rely on the ability of the liquid crystal to orient itself under the influence of an electric field. Therefore, since the liquid crystal must physically move in order to change intensity, the viscous nature of the liquid crystal material itself contributes to the appearance of ghosting artifacts.

In order to reduce and/or eliminate this deterioration in image quality, the LC response time is reduced by overdriving the pixel values such that a target pixel value (t) is reached, or almost reached, within a single frame period. In particular, by biasing the input voltage of a given pixel to an overdriven pixel value that exceeds the target pixel value for the current frame, the transition between the starting pixel value and target pixel value is accelerated in such a way that the pixel is driven to the target pixel value within the designated frame period. However, in order to efficiently calculate the overdrive pixel value, an LCD overdrive table is used that provides the appropriate overdrive pixel value that corresponds to a start, target pixel pair. Conventional overdrive tables are configured in such a way that only those data points that result from "sub-sampling" of a full overdrive table (not shown) having 256×256 entries, one for each combination of start and target pixel (s,t) are included in the table. Accordingly, since the sub-sampled overdrive table is based upon a 32-pixel-wide grid (i.e., {0, 32, 64, 96, 128, 160, 192, 224, 255}), there are a number of "missing" rows and columns corresponding to the data points that fall outside of the sampling grid. Therefore, these "missing" values are estimated at runtime based on any of a number of well known interpolation schemes that are used to "read between the lines" of the sparsely populated overdrive table.

Ideally, if the start pixel value s equals the target pixel value t, then the overdrive pixel p should also be equal since no transition will occur making overdriving unnecessary. If the interpolated overdrive surface has the equation $\mu=f(s,t)$, then the interpolated overdrive surface contains a straight line above the diagonal s=t, (i.e., $f(s,s)=s$).

Instead of a straight line across the diagonal, however, bilinear interpolation results in an arc. This means that overdrive will take place even when the start and target pixels have the same brightness. Hence, processing static pictures using bilinear interpolation will generate noise in the output in regions that remain relatively static. A surface triangulation interpolation method models the interpolated surface by splitting it into two planes such that a straight line can be found in the diagonal of the interpolated surface. Using the surface triangulation method, processing static pictures would not generate any noise since the overdrive value equals the target pixel value when the start and target pixel values are equal. Nevertheless, this method basically models the entire surface by triangles only and produces a surface that is not as smooth as the one derived from bilinear interpolation. This occurs since three sample points as compared to the four used in bilinear interpolation control the interpolated result.

When a static image is displayed on the LCD, it is crucial that the image displayed has no distortion and that no artifacts are introduced due to the overdrive algorithm. The noise generated by bilinear interpolation of the main diagonal of the overdrive table (i.e., when the start pixel value s equals the target pixel value t ) is unacceptable. However, although well suited to interpolate along the main diagonal, the use of surface triangulation is not as accurate for all other situations off the main diagonal where it produces a rougher surface.

Therefore what is required is a technique for interpolation of an LCD overdrive table for static images, i.e., improved main diagonal interpolation.

SUMMARY OF THE DISCLOSURE

What is provided is a method, apparatus, and system suitable for implementation in Liquid Crystal Display (LCDs) that reduces a pixel element response time that enables the display of high quality fast motion images thereupon. In a liquid crystal display device having a number of pixels, a method for reducing a response time of the pixels corresponding to a period of time required for a selected pixel at a starting pixel value to reach a target pixel value that substantially eliminates static image artifacts due to interpolation on the matrix main diagonal is described. The method can be implemented by the following operations. Providing an n×n factored zero diagonal LCD overdrive matrix that associates a range of start pixel values to a subset of n start pixel values and associates a range of target pixel values to a subset of n target pixel values each of which, in turn, corresponds to an overdrive pixel value. For a selected pixel at a particular start pixel value, selecting a particular target pixel value to be reached in one frame time, and determining a particular overdrive pixel value based upon the particular start pixel value and the particular target pixel value using the factored zero diagonal LCD overdrive matrix. When the starting pixel value and/or the target pixel value is not a member of the subset of n start pixel values or the subset of n target pixel values, then interpolating between a nearest pair of the subset of n start pixel values and a nearest pair of the subset of n target pixel values. When the start pixel value and the target pixel value are equal in value, then setting the overdrive pixel value to a main diagonal pixel value such that the start pixel value is equal to the target pixel value.

In another embodiment of the invention, computer program product for reducing a response time of the pixels corresponding to a period of time required for a selected pixel at a starting pixel value to reach a target pixel value is disclosed.

DETAILED DESCRIPTION OF SELECTED EMBODIMENTS

Figure 1:
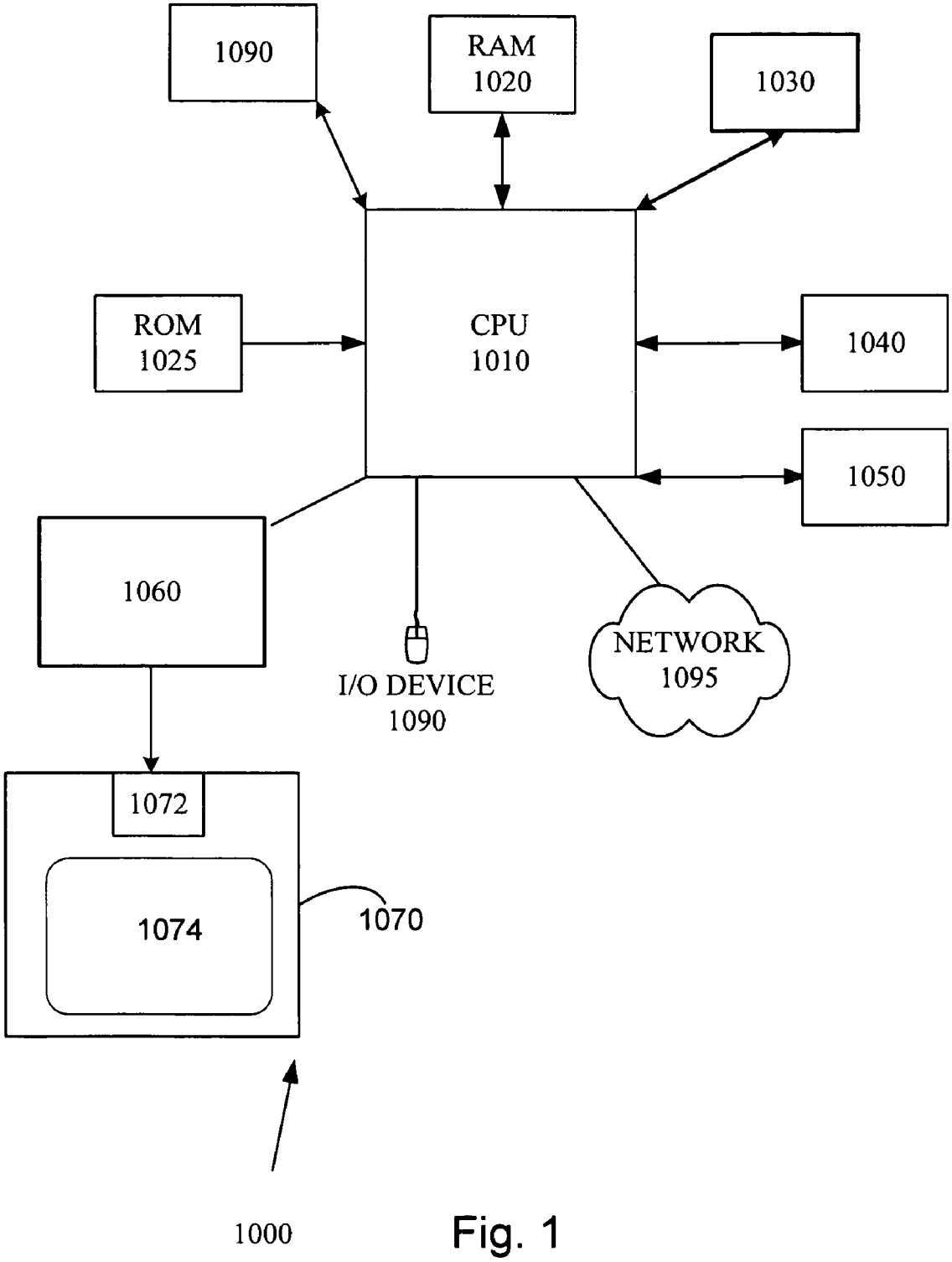
FIG. 1 illustrates a system employed to implement the invention.

Reference will now be made in detail to a particular embodiment of the invention an example of which is illustrated in the accompanying drawings. While the invention will be described in conjunction with the particular embodiment, it will be understood that it is not intended to limit the invention to the described embodiment. To the contrary, it is intended to cover alternatives, modifications, and equivalents as may be included within the spirit and scope of the invention as defined by the appended claims.

An LCD overdrive table is configured as an n×n (i.e., square) matrix of ROM based lookup data that assists in improving the runtime performance of slow LCD panels. The entries specify start pixel by column and target pixel by row where pixels not represented by this table are handled at runtime using various interpolation techniques, some of which are described in more detail below. However, whenever interpolation is performed along the main diagonal of the LCD overdrive table (where the start and target pixel values are equal), conventional bilinear interpolation techniques result in image regions of steady color that appear to "boil" as the interpolation imposes gratuitous perturbations on the pixel values. However, although well suited to interpolate along the main diagonal, the use of surface triangulation is not as accurate for all other situations off the main diagonal where it produces a rougher surface appearance.

Therefore, in order to address the issues related to interpolation along the main diagonal of an LCD overdrive table, a system, apparatus, and method based on matrix-factoring that allows bilinear (or higher-order) interpolation to be used throughout the entire overdrive matrix and yet still guarantees exact interpolations along the diagonal is described.

In order to improve the performance of slow LCD panels, the performance of the LCD panel is first characterized by, for example, taking a series of measurements that show what each pixel will do by the end of one frame time. Such measurements are taken for a representative pixel (or pixels) each being initially at a starting pixel value s that is then commanded toward a target value t (where s and t each take on integer values from 0 to 255). If the pixel value actually attained in one frame time is p, then $$p=f_s(t) \tag{1}$$

where $f_s$ is the one-frame pixel-response function corresponding to a fixed start-pixel s. For example, the one-frame pixel response function $f_s(t)$ for a pixel having a start pixel value s=32 and a target pixel value t=192 that can only reach a pixel value p=100 is represented as $f_{32}(192)=100$. For slow panels (where most if not all targets can not be reached within a frame time) functions m(s) and M(s) give the minimum pixel value and maximum pixel value, respectively, reachable in one frame time as functions of the start pixel value s that define maximum-effort curves. Therefore, in order to reach a pixel value p that lies within the interval [m(s),M(s)], equation (1) is solved for the argument that produces pixel value p referred to as the overdrive pixel value that will achieve the goal (i.e., pixel value p ) in one frame time. If p<m(s), then the overdrive pixel value is taken as having a best-effort value of 0, with m(s) being the best-effort result achieved. Likewise, if p>M(s) then the overdrive pixel is taken to be 255, with M(s) being the best-effort result. Thus, for a given start pixel s, overdrive function $g_s$ can be defined by equation 2 as $$g_s(p)=\begin{cases}0, & p<m(s)\\ f_s^{-1}(p), & m(s)\le p\le M(s)\\ 255, & p>M(s)\end{cases} \tag{2}$$

In this way, the overdrive pixel value is effective in compelling the pixel to reach its target value in the non-saturation regions and M(s) and m(s) in saturation regions $S_M$ and $S_m$ respectively. For a more detailed description, please refer to co-pending U.S. patent application Ser. No. 10/985,688 and Ser. No. 11/060,876 by Halfant that are incorporated by reference entirety for all purposes.

As described above, it is especially important to eliminate even small errors that occur on the main diagonal where start and target pixels are the same in steady images where pixel shade does not change from frame to frame. If start and target pixels are equal, the overdrive pixel should have the same value as both the start and target pixel values as well. Therefore, in terms of the overdrive function $g_s$ for the main diagonal is defined in (3) as, $$g_s(s)=s. \tag{3}$$

The Factored Zero-Diagonal Matrix Approach

For the following discussion, the overdrive table (matrix) can be considered as a square matrix F being a two-dimensional point sampling of a known function f(x, y) defined for a continuous range of x and y . The sub sampling sequences $\{x_i\}$ and $\{y_i\}$ are identical; F is given explicitly by equation (4) as, $$F(i,j)=f(x_i,y_j) \tag{4}$$

In the case where the function f is the overdrive surface $f(s,t)=g_s(t)$ and the sampling sequences are given by $\{s_i\}=\{t_i\}=\{0,32,64,\ldots 255\}$, during runtime, the matrix F is interpolated at values of s and t not represented in the sampling sequence, i.e., "read between the lines". As previously described, since bilinear interpolation is to be used and the sampling grid is going to be coarse, these interpolations may not very accurately reproduce the true values f(s, t) in general. However in order to avoid the aforementioned problems with static images or portions thereof, one must ensure that the function $f(s, t)$ is reproduced exactly along the main diagonal s=t. Accordingly, a diagonal function $\phi(s)$ defined in equation (5) as, $$\phi(s) \triangleq f(s,s) \tag{5}$$

In the overdrive case, $\phi(s)$ is the identity function $\phi(s)=s$. By defining a new function z by $$z(s, t)=f(s, t)-\phi(s) \tag{6}$$

the problem is converted into an equivalent one in which the diagonal function z(s,s) is identically zero (since $f(s,s)=\phi(s)$). The matrix counterpart of equation (6) is achieved by subtracting from the matrix F a matrix $\Phi$ each of whose columns is just the sequence $\{\phi(s_i)\}$.

$$\Phi = \begin{bmatrix} \varphi(s_1) & \varphi(s_1) & \cdots & \varphi(s_1) \\ \varphi(s_2) & \varphi(s_2) & \cdots & \varphi(s_2) \\ \vdots & \vdots & \iddots & \vdots \\ \varphi(s_n) & \varphi(s_n) & \cdots & \varphi(s_n) \end{bmatrix} \tag{7}$$

Thus, $$Z=F-\Phi \tag{8}$$

where the matrix Z has zeros on the main diagonal, just as its continuous counterpart, z(s, t), is identically 0 along the diagonal s=t. From this it can be inferred that z(s, t) contains (t−s) as a factor as shown in equation (9) as:

$$z(s, t)=(t-s)^* m(s, t) \tag{9}$$

where m(s, t) is a new function defined for s≠t by equation (9). In this way, equation (9) only defines m(s, t) off the main diagonal, since the inversion $$m(s, t) = \frac{z(s, t)}{t-s} \tag{10}$$

cannot be used when the right-hand-side denominator is 0. (It should be noted that m(s, t) corresponds to a matrix M just as $f$ corresponds to the matrix F and z corresponds to the matrix Z.)

When the matrix M is interpolated, any interpolation errors on the main diagonal are eliminated since the interpolated estimate of m(s, t) is multiplied by (t−s) as in (9) and produces exactly 0 on the diagonal. The function $f(s,t)$ is recovered by adding back $\phi(s)$ as seen from equation (6). While on the diagonal, the reconstructed $f(s, s)$ will exactly equal $\phi(s)$ as required.

Since the matrix M must be interpolated and any discordant values on the main diagonal will undermine the interpolation for near-diagonal values, equation (10) is evaluated when s and t are very close. Therefore, rewriting equation (10) using the fact that z(s, s)=0:

$$m(s, t) = \frac{z(s, t) - z(s, s)}{t-s}. \tag{11}$$

In the case that s is held fixed, and t=s+h (where h is a small quantity that approaches 0 in the limit), equation (12)

$$m(s, s) = \lim_{h\to 0} \frac{z(s, s+h) - z(s, s)}{h} = \left.\frac{\partial z(s, t)}{\partial t}\right|_{t=s} \tag{12}$$

Hence the right values to use on the diagonal are partial derivatives of the original function z, with respect to the second argument t evaluated on the diagonal. Actually, $f$ can be used in place of z, since from (6) they differ by a function of s and therefore have identical partial derivatives with respect to t.

However, since neither $f$ nor z is available, the sampled matrices F and Z are used to estimate the partial derivatives required. In the described embodiment, holding s fixed means looking at a row of Z which is fitted with a polynomial curve (such as a cubic spline type polynomial or a least squares fitted polynomial of a specified degree if the data points are noisy) and use the derivative of that polynomial curve where it crosses the diagonal.

It should be noted that the inventive factored zero diagonal matrix approach described herein is applicable to the interpolation of analytic functions $f(s,t)$ given by explicit formula as well as for empirical data (in which case only the measured values $f(s_i,t_j)$ really exist). In the former case, the partial derivatives can be computed exactly from the explicit function $f(s,t)$, whereas in the latter case, the partial derivatives are estimated by the ordinary derivatives of row-fitted polynomials.

We illustrate the previous ideas with a numerical example. Assume that the function to be computed at runtime is $$f(x,y)=255\cdot\sin(x+y^2) \tag{ex1}$$

where x and y each goes from 0 to 1. The partial derivative with respect to the second variable is $$f_2(x, y) = \frac{\partial f}{\partial y} = 510\cdot y\cdot\cos(x+y^2) \tag{ex2}$$

and the diagonal function is $$\phi(x)=f(x,x)=255\cdot\sin(x+x^2) \tag{ex3}$$

For convenience we'll work with a small matrix of dimension 5×5, with the five-point subsampling sequence given by $$\{x_{i}\}=\{y_{j}\}=\{0, 0.25, 0.5, 0.75, 1\} \tag{ex4}$$

The subsampling matrix based on this is $$F = f(x_i, y_j) \tag{ex5}$$

$$= \begin{bmatrix} 0 & 15.9271 & 63.0880 & 135.9922 & 214.5751 \\ 63.0880 & 78.3968 & 122.2535 & 185.1322 & 241.9911 \\ 122.2535 & 135.9922 & 173.8179 & 222.7616 & 254.3612 \\ 173.8179 & 185.1322 & 214.5751 & 246.5408 & 250.9164 \\ 214.5751 & 222.7616 & 241.9911 & 254.9912 & 231.8708 \end{bmatrix}$$

Given this matrix at runtime, how would we calculate $f(0.375, 0.625)$? From equation (ex1) we find that the answer is 176.7119, but we cannot read that value directly from the matrix F because the arguments x and y each falls midway between terms of the subsampling sequence (ex4): x corresponds to an index of i=2.5 and y to j=3.5. Of course that's what interpolation is all about—we seek the numerical value that lies in the "middle" of the submatrix $$F(2{:}3,\ 3{:}4) = \begin{bmatrix} 122.2535 & 185.1322 \\ 173.8179 & 22.7616 \end{bmatrix} \tag{ex6}$$

For this especially easy case, bilinear interpolation reduces to averaging the four corner values to find the value in the center:

$$F_{2.5,\ 3.5}=175.9913 \tag{ex7}$$

Notice that this is reasonably close to the "exact" answer 176.7119. Now let us see how things would work in the Factored Zero-Diagonal Matrix case. To begin with we compute following equation (7) the matrix Φ each of whose columns is the diagonal function ϕ evaluated on the sequence (ex4):

$$\Phi = \begin{bmatrix} 0 & 0 & 0 & 0 & 0 \\ 78.3968 & 78.3968 & 78.3968 & 78.3968 & 78.3968 \\ 173.8719 & 173.8719 & 173.8719 & 173.8719 & 173.8719 \\ 246.5408 & 246.5408 & 246.5408 & 246.5408 & 246.5408 \\ 231.8708 & 231.8708 & 231.8708 & 231.8708 & 231.8708 \end{bmatrix} \tag{ex8}$$

Then, following equation (8), we compute $$Z = F - \Phi \tag{ex9}$$

$$= \begin{bmatrix} 0 & 15.9271 & 63.0880 & 135.9922 & 214.5751 \\ -15.3088 & 0 & 43.8567 & 106.7354 & 163.5943 \\ -51.5644 & -37.8257 & 0 & 48.9437 & 80.5433 \\ -72.7229 & -61.4086 & -31.9657 & 0 & 4.3756 \\ -17.2957 & -9.1092 & 10.1202 & 23.1204 & 0 \end{bmatrix}$$

Now, following equation (10), we proceed to divide out the implicit factor $(y_j-x_i)$ for the off-diagonal cases where $i \neq j$ (and hence $y_j-x_i \neq 0$):

$$M = \begin{bmatrix} \cdots & 63.7085 & 126.1760 & 181.3229 & 214.5751 \\ 61.2352 & \cdots & 175.4268 & 213.4708 & 218.1257 \\ 103.1287 & 151.3028 & \cdots & 195.7749 & 161.0867 \\ 96.9639 & 122.8171 & 127.8627 & \cdots & 17.5026 \\ 17.2957 & 12.1456 & -20.2405 & -92.4815 & \cdots \end{bmatrix} \tag{ex 10}$$

The diagonal elements remain to be computed. Great accuracy is not required because any element that would appear on the interpolated diagonal of M will be multiplied by a factor (y−x) equal to 0; none-the-less, wildly discordant values would undermine interpolation of nearby off-diagonal elements of M. As shown in equation (12), the natural choice for the diagonal elements comes from evaluating the partial derivatives of z on the subsampling sequence (ex4). As remarked, $f$ can be used in place of z, since they differ by a function that does not involve the second variable. Accordingly, we apply the function $f_2$ given in (ex2) to obtain the diagonal terms for M:

$$\text{diag}=\{0,\ 121.3249,\ 186.5807,\ 97.7034,\ -212.2349\} \tag{ex11}$$

When the data in F is obtained empirically, and there is no analytic function $f$ from which partial derivatives can be obtained, we achieve the same effect by fitting each row of Z with a polynomial and using its derivative at the diagonal point as an estimate of the partial derivative sought. In this example, fitting cubic splines to each of the rows of Z produces this alternate set of diagonal terms for M:

$$\text{altdiag}=\{-1.2216,\ 122.0956,\ 187.3492,\ 95.1757,\ -208.7838\} \tag{ex12}$$

It is seen that these do not differ significantly from the values in (ex11), which we will finally insert to complete the matrix M:

$$M = \begin{bmatrix} 0 & 63.7085 & 126.1760 & 181.3229 & 214.5751 \\ 61.2352 & 121.3249 & 175.4268 & 213.4708 & 218.1257 \\ 103.1287 & 151.3028 & 186.5807 & 195.7749 & 161.0867 \\ 96.9639 & 122.8171 & 127.8627 & 97.7034 & 17.5026 \\ 17.2957 & 12.1456 & -20.2405 & -92.4815 & -212.2349 \end{bmatrix} \tag{ex 13}$$

Finally, we repeat the interpolation exercise of (ex7), this time using the Factored Zero-Diagonal Matrix M in place of F. Analogously to (ex6), we extract the relevant submatrix of M:

$$M(2:3,\ 3:4) = \begin{bmatrix} 175.268 & 213.4708 \\ 186.5807 & 195.7749 \end{bmatrix} \tag{ex 14}$$

and apply bilinear interpolation to compute the value in the "middle" as the average of values at the four corners:

$$M_{2.5,\ 3.5}=192.8133 \tag{ex15}$$

This value is next multiplied by the (y−x) term (0.625−0.375) to give 48.2033. Then we have only to reverse equation (6) by adding back ϕ(x)=ϕ(0.375)=125.7351 for a final result $$F_{2.5,\ 3.5}\approx 173.9384 \tag{ex16}$$

Notice that this differs by about 1% from the value computed in (ex7) from F directly. One final comment is perhaps in order. Here in the last stage we computed the "addback" quantity ϕ(x) directly from the function definition (ex3). In the overdrive case, where ϕ(x)≡x is just the identity function, no computation is necessary. In the more general situation depicted in this example, ϕ(x) might be too expensive to compute at runtime; in that event, values would be cached in a linear table for lookup at runtime. For example, if the argument x is to be an 8-bit quantity, then a table of length 256 would store the values $$\left\{\psi\left(\frac{i-1}{255}\right),\ i = 1, 2, \ldots, 255\right\}.$$

This small expenditure of space would allow interpolation to 8-bits with guaranteed exact reproduction of ϕ on the main diagonal.

FIG. 1 illustrates a system 1000 employed to implement the invention. Computer system 1000 is only an example of a graphics system in which the present invention can be implemented. System 1000 includes central processing unit (CPU) 1010, random access memory (RAM) 1020, read only memory (ROM) 1025, one or more peripherals 1030, graphics controller 1060, primary storage devices 1040 and 1050, and digital display unit 1070. CPUs 1010 are also coupled to one or more input/output devices 1090 that may include, but are not limited to, devices such as, track balls, mice, keyboards, microphones, touch-sensitive displays, transducer card readers, magnetic or paper tape readers, tablets, styluses, voice or handwriting recognizers, or other well-known input devices such as, of course, other computers. Graphics controller 1060 generates image data and a corresponding reference signal, and provides both to digital display unit 1070. The image data can be generated, for example, based on pixel data received from CPU 1010 or from an external encode (not shown). In one embodiment, the image data is provided in RGB format and the reference signal includes the Vsync and Hsync signals well known in the art. However, it should be understood that the present invention can be implemented with image, data and/or reference signals in other formats. For example, image data can include video signal data also with a corresponding time reference signal.

Figure 2:
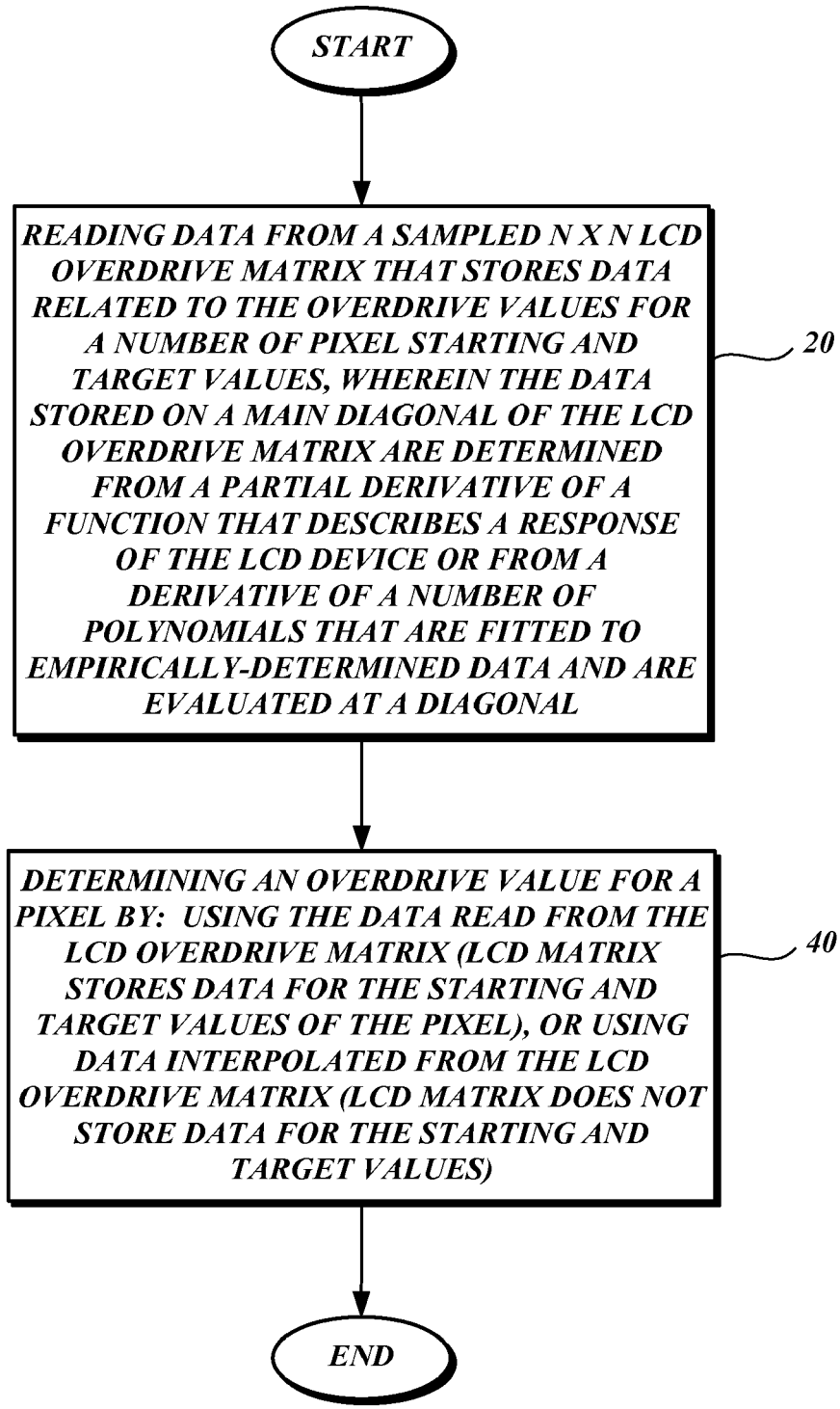
FIG. 2 illustrates one embodiment of a method executed by a processor to determine an overdrive value for a pixel in a liquid crystal display (LCD) device in order to reduce a response time of the pixel to change between a starting pixel value and a target pixel value.

FIG. 2 illustrates a method executed by a processor to determined an overdrive value for a pixel in a liquid crystal display (LCD) device in order to reduce a time of the pixel to change between a starting pixel value and a target pixel value by:

reading data from a sampled n×n LCD overdrive matrix that stores data related to the overdrive values for a number of pixel starting and target values, wherein the data stored on a main diagonal of the LCD overdrive matrix are determined from a partial derivative of a function that describes a response of the LCD device or from a derivative of a number of polynomials that are fitted to empirically-determined data and are evaluated at a diagonal (unit 20); and either determining an overdrive value for a pixel by using the data read from the LCD overdrive matrix to determine the overdrive value if the LCD overdrive matrix stores data for the starting and target values of the pixel; or using data interpolated from the LCD overdrive matrix to determine the overdrive value if the LCD overdrive matrix does not store data for the starting and values (unit 40).

Although only a few embodiments of the present invention have been described, it should be understood that the present invention may be embodied in many other specific forms without departing from the spirit or the scope of the present invention. The present examples are to be considered as illustrative and not restrictive, and the invention is not to be limited to the details given herein, but may be modified within the scope of the appended claims along with their full scope of equivalents.

While this invention has been described in terms of a preferred embodiment, there are alterations, permutations, and equivalents that fall within the scope of this invention. It should also be noted that there are many alternative ways of implementing both the process and apparatus of the present invention. It is therefore intended that the invention be interpreted as including all such alterations, permutations, and equivalents as fall within the true spirit and scope of the present invention.

What is claimed is:

1. A computer system comprising a liquid crystal display (LCD) device and a processor, wherein the LCD device has a number of pixels, and wherein the processor is configured to determine an overdrive value for a pixel in the LCD device to change from a starting pixel value to a target pixel value by:

reading data from a factored zero-diagonal n×n LCD overdrive matrix that stores data related to the overdrive values for a number of pixel starting and target values, wherein the data stored on the main diagonal of the factored zero-diagonal LCD overdrive matrix are derived from a partial derivative of a function that describes a response of the LCD device; and determining an overdrive value for a pixel by:

using the data read from the factored zero-diagonal LCD overdrive matrix to determine the overdrive value if the factored zero-diagonal LCD overdrive matrix stores data for the starting and target values; or using data interpolated from the factored zero-diagonal LCD overdrive matrix to determine the overdrive value if the factored zero-diagonal LCD overdrive matrix does not store data for the starting and target values.

2. The computer system of claim 1, wherein the processor is configured to determine the overdrive pixel value by using the data read from the factored zero-diagonal LCD overdrive matrix or interpolated from the data read from the factored zero-diagonal LCD overdrive matrix and multiplied by a difference between the target and starting values of the pixel plus an addback quantity.

3. A computer storage media including instructions that are executable by a processor to determine overdrive values for pixels in a liquid crystal display (LCD) device by:

reading data from a factored zero-diagonal n×n LCD overdrive matrix that stores data related to the overdrive values for a number of pixel starting and target values, wherein the data stored on the main diagonal of the factored zero-diagonal LCD overdrive matrix are derived from a partial derivative of a function that describes a response of the LCD device; and determining an overdrive value for a pixel by:

using the data read from the factored zero-diagonal LCD overdrive matrix to determine the overdrive value if the factored zero-diagonal LCD overdrive matrix stores data for the starting and target values of the pixel; or using data interpolated from the factored zero-diagonal LCD overdrive matrix to determine the overdrive value if the factored zero-diagonal LCD overdrive matrix does not store data for the starting and target values of the pixel.

4. The computer storage media of claim 3, wherein the instructions further comprise instructions that cause the processor to determine the overdrive pixel value by using the data read from the factored zero-diagonal LCD overdrive matrix or interpolated from the data read from the factored zero-diagonal LCD overdrive matrix and multiplied by a difference between the target and starting values of the pixel plus an addback quantity.

5. A method executed by a processor to determine an overdrive value for a pixel in a liquid crystal display (LCD) device in order to reduce a response time of the pixel to change between a starting pixel value and a target pixel value by:

reading data from a factored zero-diagonal n×n LCD overdrive matrix that stores data related to the overdrive values for a number of pixel starting and target values, wherein the data stored on a main diagonal of the factored zero-diagonal LCD overdrive matrix are derived from a partial derivative of a function that describes the response of the LCD device; and either determining an overdrive value for a pixel by using the data read from the factored zero-diagonal LCD overdrive matrix to determine the overdrive value if the factored zero-diagonal LCD overdrive matrix stores data for the starting and target values of the pixel; or using data interpolated from the factored zero-diagonal LCD overdrive matrix to determine the overdrive value if the factored zero-diagonal LCD overdrive matrix does not store data for the starting and target values.

6. A computer system comprising a liquid crystal display (LCD) device and a processor, wherein the LCD device has a number of pixels, and wherein the processor is configured to determine an overdrive value for a pixel in the LCD device to change from a starting pixel value to a target pixel value by:

reading data from a factored zero-diagonal n×n LCD overdrive matrix that stores data related to the overdrive values for a number of pixel starting and target values, wherein the data stored on the main diagonal of the factored zero-diagonal LCD overdrive matrix are determined from a derivative of a number of polynomials that are fitted to empirically-determined data and are evaluated at a diagonal; and determining an overdrive value for a pixel by:

using the data read from the factored zero-diagonal LCD overdrive matrix to determine the overdrive value if the factored zero-diagonal LCD overdrive matrix stores data for the starting and target values; or using data interpolated from the factored zero-diagonal LCD overdrive matrix to determine the overdrive value if the factored zero-diagonal LCD overdrive matrix does not store data for the starting and target values.

7. The computer system of claim 6, wherein the processor is configured to determine the overdrive pixel value by using the data read from the factored zero-diagonal LCD overdrive matrix or interpolated from the data read from the factored zero-diagonal LCD overdrive matrix and multiplied by a difference between the target and starting values of the pixel plus an addback quantity.

8. A computer storage media including instructions that are executable by a processor to determine overdrive values for pixels in a liquid crystal display (LCD) device by:

reading data from a factored zero-diagonal n×n LCD overdrive matrix that stores data related to the overdrive values for a number of pixel starting and target values, wherein the data stored on the main diagonal of the factored zero-diagonal LCD overdrive matrix are determined from a derivative of a number of polynomials that are fitted to empirically-determined data and are evaluated at a diagonal; and determining an overdrive value for a pixel by:

using the data read from the factored zero-diagonal LCD overdrive matrix to determine the overdrive value if the factored zero-diagonal LCD overdrive matrix stores data for the starting and target values of the pixel; or using data interpolated from the factored zero-diagonal LCD overdrive matrix to determine the overdrive value if the factored zero-diagonal LCD overdrive matrix does not store data for the starting and target values of the pixel.

9. The computer storage media of claim 8, wherein the instructions further comprise instructions that cause the processor to determine the overdrive pixel value by using the data read from the factored zero-diagonal LCD overdrive matrix or interpolated from the data read from the factored zero-diagonal LCD overdrive matrix and multiplied by a difference between the target and starting values of the pixel plus an addback quantity.

10. A method executed by a processor to determine an overdrive value for a pixel in a liquid crystal display (LCD) device in order to reduce a response time of the pixel to change between a starting pixel value and a target pixel value by:

reading data from a factored zero-diagonal n×n LCD overdrive matrix that stores data related to the overdrive values for a number of pixel starting and target values, wherein the data stored on a main diagonal of the factored zero-diagonal LCD overdrive matrix are determined from a derivative of a number of polynomials that are fitted to empirically-determined data and are evaluated at a diagonal; and either determining an overdrive value for a pixel by using the data read from the factored zero-diagonal LCD overdrive matrix to determine the overdrive value if the factored zero-diagonal LCD overdrive matrix stores data for the starting and target values of the pixel; or using data interpolated from the factored zero-diagonal LCD overdrive matrix to determine the overdrive value if the LCD overdrive matrix does not store data for the starting and target values.

* * * * *

UNITED STATES PATENT AND TRADEMARK OFFICE

CERTIFICATE OF CORRECTION

PATENT NO. : 7,777,707 B2
APPLICATION NO. : 11/061054
DATED : August 17, 2010
INVENTOR(S) : Halfant It is certified that error appears in the above-identified patent and that said Letters Patent is hereby corrected as shown below:

Column 1, line 8, delete "U.S.C. 119" and insert -- U.S.C. § 119 --.

Column 1, line 10, delete "2004" and insert -- 2004, --.

Column 2, line 13, delete "μ=f(s,t)," and insert -- u=f(s,t), --.

Column 2, line 38, delete "t )" and insert -- t) --.

Column 4, line 16, delete "p )" and insert -- p) --.

Column 4, lines 31-32, delete "$S_m$respectively." and insert -- $S_m$ respectively. --.

Column 4, line 52, delete "y ." and insert -- y. --.

Column 4, line 53, delete "$\{y_i\}$" and insert -- $\{y_j\}$ --.

Column 6, line 32, delete "$255\cdot\sin(x+y^2)$" and insert -- $255\cdot\sin(x+y^2)$ --.

Column 6, line 38, delete "$\frac{\partial f}{\partial y}$" and insert -- $\frac{\partial f}{\partial y}$ --.

Column 6, line 43, delete "$255\cdot\sin(x+x^2)$" and insert -- $255\cdot\sin(x+x^2)$ --.

Column 6, line 47, delete "$\{x_{i\}=\{yj\}}$" and insert -- $\{X_i\}=\{\mathbf{y_j}\}$ --.

Column 7, line 47, delete "(ex 10)" and insert -- (ex10) --.

Column 8, line 18, delete "(ex 13)" and insert -- (ex13) --.

Signed and Sealed this
Twenty-fourth Day of May, 2011

David J. Kappos

David J. Kappos
*Director of the United States Patent and Trademark Office*

Column 8, line 33, delete "(ex 14)" and insert -- (ex14) --.

Column 8, line 60, delete ψ and insert -- φ --.

Column 9, line 25, delete "determined" and insert -- determine --.

Column 9, line 26, delete "a time" and insert -- a response time --.

Column 9, line 44, delete "and values" and insert -- and target values --.